US009045911B2

(12) United States Patent
Hoffman et al.

(10) Patent No.: US 9,045,911 B2
(45) Date of Patent: Jun. 2, 2015

(54) REUSABLE SHIM SHELL MECHANICAL EDGE SETTING SYSTEM AND METHOD FOR SETTING TILES AND TUNING LIPPAGE

(71) Applicant: New Standards Manufacturing Co., Keokuk, IA (US)

(72) Inventors: James P. Hoffman, Keokuk, IA (US); Ernest L. Perry, IV, Keokuk, IA (US); Michele Volponi, Keukuk, IA (US)

(73) Assignee: New Standards Manufacturing Co., Keokuk, IA (US)

( * ) Notice: Subject to any disclaimer, the term of this patent is extended or adjusted under 35 U.S.C. 154(b) by 0 days.

(21) Appl. No.: 14/512,811

(22) Filed: Oct. 13, 2014

(65) Prior Publication Data

US 2015/0027082 A1 Jan. 29, 2015

Related U.S. Application Data

(63) Continuation of application No. 13/892,698, filed on May 13, 2013.

(60) Provisional application No. 61/646,677, filed on May 14, 2012.

(51) Int. Cl.

| | |
|---|---|
| ***E04B 2/82*** | (2006.01) |
| ***E04B 9/00*** | (2006.01) |
| ***E04G 1/22*** | (2006.01) |
| ***E04F 21/18*** | (2006.01) |
| ***E04F 21/20*** | (2006.01) |

(52) U.S. Cl.

CPC ..... *E04F 21/1877* (2013.01); *E04F 21/20* (2013.01)

(58) Field of Classification Search

CPC ..... E04F 21/00; E04F 21/1877

USPC ..... 52/747.11, 749.11, 126.6, 745.13, 52/122.1, 126.1, DIG. 1; 33/527, 533, 613

See application file for complete search history.

(56) References Cited

U.S. PATENT DOCUMENTS

| | | | |
|---|---|---|---|
| 1,918,228 | A | 7/1933 | Spencer |
| 2,277,892 | A | 3/1942 | Swenson |
| 3,511,001 | A | 5/1970 | Morgan |
| 4,397,125 | A | 8/1983 | Gussler |
| 5,345,990 | A | 9/1994 | Potts |
| 5,603,195 | A | 2/1997 | Consentino |
| 5,675,942 | A | 10/1997 | Crawford |
| 5,843,546 | A | 12/1998 | Eichhorn |
| 6,253,515 | B1 | 7/2001 | Kuelker |
| 7,257,926 | B1 | 8/2007 | Kirby |
| D552,266 | S | 10/2007 | Murdock |

(Continued)

FOREIGN PATENT DOCUMENTS

| | | |
|---|---|---|
| JP | 07-305494 A | 11/1995 |
| WO | PCT/US2012/055482 | 9/2012 |

OTHER PUBLICATIONS

Kufner et al, The Lippage-Free Tile System, Web (www.tuscanleveling.com), 2006, Fairfield, IA.

*Primary Examiner* — Chi Q Nguyen

(74) *Attorney, Agent, or Firm* — Simmons Perrine Moyer Bergman PLC

(57) ABSTRACT

A tile aligning and lippage tuning system that uses an under tile base interstitial strap, which is connected to said under tile base, a shim shell cap configured to slip over the connecting tab. A bottom tile mating shim and a top shim.

20 Claims, 4 Drawing Sheets

(56) References Cited

U.S. PATENT DOCUMENTS

| | | | | |
|---|---|---|---|---|
| 7,621,100 | B2 | 11/2009 | Kufner et al. | |
| D621,966 | S | 8/2010 | Vaes | |
| D630,077 | S | 1/2011 | Kufner et al. | |
| D630,078 | S | 1/2011 | Kufner et al. | |
| 7,861,487 | B2 | 1/2011 | Kufner et al. | |
| 7,946,093 | B1 | 5/2011 | Sturino | |
| D640,119 | S | 6/2011 | Kufner et al. | |
| 7,954,300 | B1 | 6/2011 | Kufner et al. | |
| 7,992,354 | B2 | 8/2011 | Doda | |
| 8,011,164 | B2 | 9/2011 | Kufner et al. | |
| 8,079,199 | B1 | 12/2011 | Kufner et al. | |
| D658,963 | S | 5/2012 | Kufner et al. | |
| 8,336,279 | B2 | 12/2012 | Kufner et al. | |
| 8,429,878 | B1 | 4/2013 | Hoffman et al. | |
| 8,429,879 | B1 | 4/2013 | Hoffman et al. | |
| 8,561,370 | B1 | 10/2013 | Hoffman et al. | |
| 8,572,927 | B1 | 11/2013 | Hoffman et al. | |
| 8,607,530 | B2 | 12/2013 | Hoffman et al. | |
| 8,635,815 | B2 * | 1/2014 | Bordin | 52/126.1 |
| 8,671,628 | B2 * | 3/2014 | Sighinolfi | 52/126.1 |
| 8,689,521 | B1 | 4/2014 | Hoffman et al. | |
| 8,689,522 | B2 | 4/2014 | Hoffman et al. | |
| 8,690,109 | B2 * | 4/2014 | Haworth et al. | 248/219.2 |
| 2003/0177613 | A1 * | 9/2003 | Caveney et al. | 24/16 PB |
| 2006/0185269 | A1 | 8/2006 | Kufner et al. | |
| 2006/0185319 | A1 | 8/2006 | Kufner et al. | |
| 2008/0236094 | A1 * | 10/2008 | Doda | 52/749.11 |
| 2010/0263304 | A1 | 10/2010 | Torrents I Comas | |
| 2010/0287868 | A1 | 11/2010 | Kufner et al. | |
| 2011/0011031 | A1 | 1/2011 | Kufner et al. | |
| 2011/0265424 | A1 | 11/2011 | Kufner et al. | |
| 2012/0085066 | A1 | 4/2012 | Kufner et al. | |
| 2012/0144773 | A1 | 6/2012 | Mauro | |
| 2013/0255182 | A1 | 10/2013 | Kufner et al. | |

* cited by examiner

REUSABLE SHIM SHELL MECHANICAL EDGE SETTING SYSTEM AND METHOD FOR SETTING TILES AND TUNING LIPPAGE

CROSS REFERENCE TO RELATED APPLICATIONS

This application claims the benefit of a provisional application filed on May 14, 2012, and having Ser. No. 61/646,677 which is hereby incorporated herein in its entirety by this reference. This application also claims the benefit of a utility application filed on May 13, 2013, and having Ser. No. 13/892,698 entitled "REUSABLE SHIM SHELL MECHANICAL EDGE SETTING SYSTEM AND METHOD FOR SETTING TILES AND TUNING LIPPAGE" which is hereby incorporated herein in its entirety by this reference.

BACKGROUND OF THE INVENTION

This invention relates to systems and methods for laying tile and more specifically for efficiently reducing tile lippage. Throughout this description, the term tile is used as an example of various matter which is arranged or disposed adjacent a substrate (which can be horizontal—floors or vertical—walls or other) in multiple pieces, the term tile should be understood to include panels, sheets, boards, paving stones, bricks, stone or porcelain slabs, or the like. The present invention relates more specifically to improved methods and systems which use tab systems to align tiles.

U.S. Pat. No. 7,861,487, U.S. Design Patent D63077 and the web site www.tuscanleveling.com describe a system for aligning tiles. While such systems have enjoyed some success in the past, they do have drawbacks. Typically, such systems require the use of a tool to tighten a strap and cap combination. The tile laying professional would typically use the tool by firmly grasping a lever, trigger or other structure on the tool and causing the gap between the cap and the base of the strap to decrease. The amount and duration of the squeezing of the tool, in some designs, may determine the amount of relative movement between the cap and the base of the strap. Knowing how hard to squeeze and when to stop could be a critical skill in certain applications. Also having the requisite hand grasping strength could be an issue for some tile laying professionals.

Consequently, there is a need for improvement in tile aligning and lippage tuning systems and methods.

SUMMARY OF THE INVENTION

More specifically, an object of the invention is to provide a cost effective tile aligning and mechanical edge setting system.

It is a feature of the present invention to include a tool-less cap structure disposed above the tile.

It is an advantage of the present invention to decrease the time required to perform each job.

It is another feature of the invention to include a cap system that is an adjustable shim shell that is detachable from the tab or shaft, while the tab remains in place, attached to the base located under the tile.

It is also an advantage of the present invention to provide improved ease of use and reduce unwanted dislocation of tiles after desired placement is accomplished.

It is another feature of the present invention to change how pressure is applied to the surface of the tile and the connecting tab.

It is another advantage of the present invention to reduce over tightening of cap and strap combinations.

The present invention includes the above-described features and achieves the aforementioned objects.

Accordingly, the present invention comprises a tile leveling and mechanical edge setting system, with a shim shell leveler which is easily installed on, and removable from, an attached connecting tab or shaft, without the need for a specialized tool.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
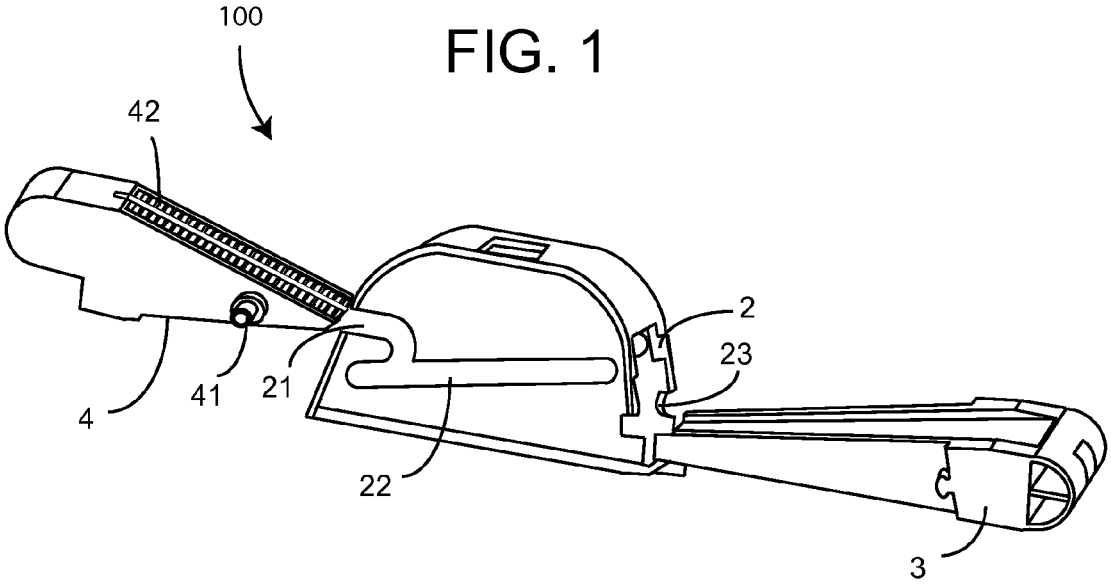
FIG. 1 is an exploded perspective view of the mechanical edge setting and lippage tuning system of the present invention.
Figure 1:
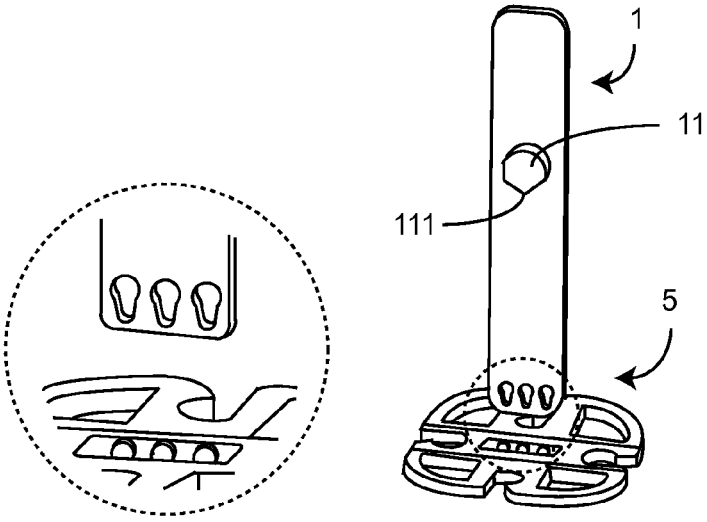

Referring now to the drawings, where like numerals refer to like matter throughout, and more particularly to FIG. 1, there is shown a mechanical edge setting and lippage tuning system, which generally includes an interstitial strap 1 and a shim shell cap 2. Interstitial strap 1 may be disposed in the interstices between adjacent tiles and may be made of metal, plastic, or rubber coated metal, or other suitable materials. Interstitial strap 1 has a top shim mating protuberance 11 with top shim mating protuberance teeth 111 thereon. Interstitial strap 1, top shim mating protuberance 11 and top shim mating protuberance teeth 111 may be all one piece of molded plastic, or other suitable configuration. Interstitial strap 1 may be a reusable strap, or a disposable strap that is destroyed upon removal, or other suitable strap arrangement for mating with a beneath tile base 5.

Shim shell cap 2 is configured with a hollow interior and an open bottom side to be placed over interstitial strap 1, and allowing a top portion of the strap to pass through and out a top orifice in the shim shell cap 2. Shim shell cap 2 has, at one end, a bottom tile mating shim receiving orifice 23 and, at an opposing end, a top shim receiving orifice therein. Between these opposing shim receiving orifices are planar opposing sides with protuberance slot entrance 21 and protuberance slot inclined portion 22. Slots 21 and 22 are configured on opposing sides of shim shell cap 2 for receiving top shim slot engaging protuberance 41, which is located on each opposing sides of top shim 4.

Additionally, the sides of shim shell cap 2 at the bottom tile mating shim receiving orifice 23 have a void therein for receiving a surface feature on the sides of bottom tile mating shim 3 nearer the wider end thereof.

Bottom tile mating shim 3 is configured with an angled top surface for slidability mating with the bottom side of top shim 4. Bottom tile mating shim 3 has a slot running to the tip for receiving strap 1.

Top shim 4 is configured to easily slide along the top side of bottom tile mating shim 3 and top shim 4 has along its angled top side top shim mating teeth 42, which are configured to engage with, and be retained by, top shim mating protuberance teeth 111 of top shim mating protuberance 11 of interstitial strap 1. Top shim 4 has a tip at its bottom edge with a central slot for receiving the strap therein.

Figure 2:
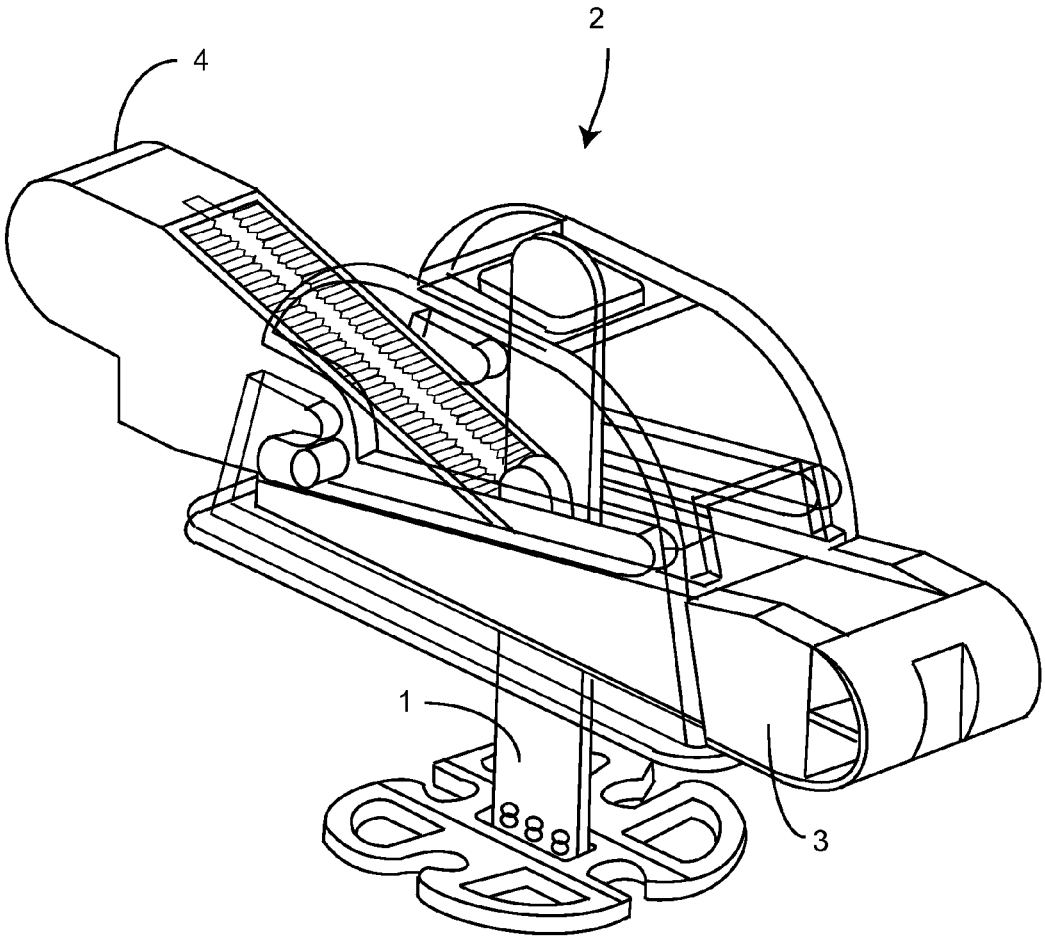
FIG. 2 is an assembled view of the system of FIG. 1.

Now referring to FIG. 2, there is shown a fully assembled configuration of the structure of FIG. 1. In FIG. 2, bottom tile mating shim 3 is fully inserted into the bottom tile mating shim receiving orifice 23 of shim shell cap 2 and top shim 4 has been inserted into shim shell cap 2 by guiding top shim slot engaging protuberance 41 on each side in its respective protuberance slot entrance 21 and dropped down in protuberance slot inclined portion 22. The top of interstitial strap 1 can be seen protruding from the top of shim shell cap 2.

Figure 3:
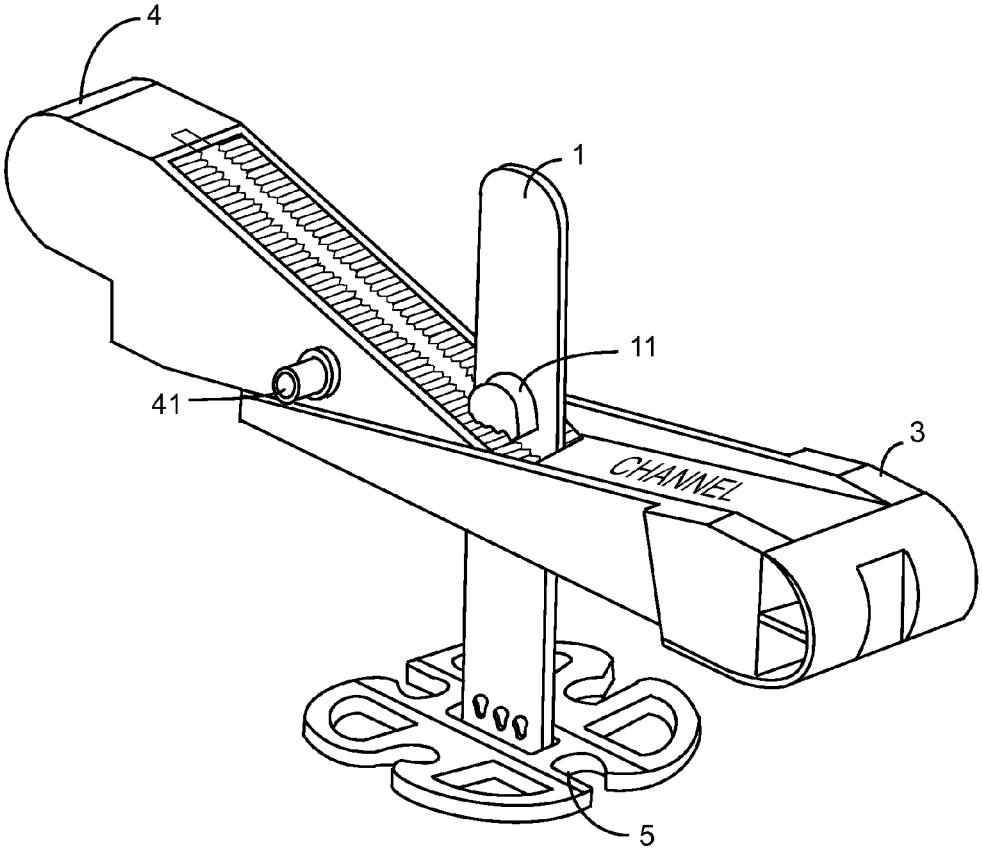
FIG. 3 is an alternate embodiment of the system of FIG. 2 which is shown in a perspective view without the shim shell cap.

Now referring to FIG. 3, there is shown a configuration of some of the components of FIG. 1. The shim shell cap 2 is omitted from the structure of FIG. 3. Indeed, shim shell cap 2 is not required for use of the present invention in some configurations. Bottom tile mating shim 3 could rest upon the top surface of the tile. Top shim 4 is configured to slide within a channel formed on the top angled ramp side of bottom tile mating shim 3. Bottom tile mating shim 3 has a central orifice therein through which the interstitial strap 1 passes therethrough. This central orifice may be a slot extending to an edge or an internally locate hole.

Figure 4:
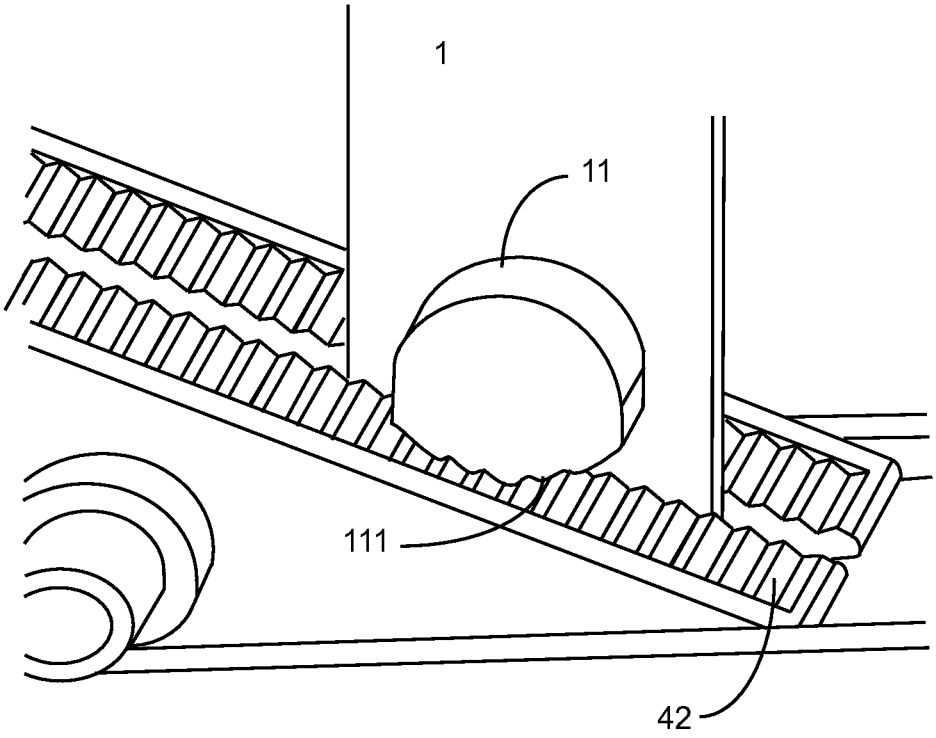
FIG. 4 is a close up view of a portion of FIG. 3.

Now referring to FIG. 4, there is shown a close up view of the system of FIG. 3 where the bottom tile mating shim 3 with the channel therein is shown clearly with the top shim 4 disposed therein.

In operation, the system of the present invention function as follows:

Beneath tile base 5 and interstitial strap 1 are deployed as usual. Bottom tile mating shim 3 is slid along the tile where a slot extending to the tip of bottom tile mating shim 3 allows for the strap 1 to extend up through the bottom tile mating shim 3. Top shim 4 is inserted into the channel of bottom tile mating shim 3 and slid therein to a point of engagement with top shim mating protuberance 11 and beyond to a point which provides the desired amount of force to reduce lippage.

Throughout this description, the term lippage is used and is hereby defined as meaning relatively uneven edges existing with respect to adjacent tiles arranged in an array.

It is believed that when these teachings are combined with the known prior art by a person skilled in the art of the prior art systems, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein shown in the accompanying drawings is to be interpreted as illustrative and not in a limiting sense.

We claim:

1. A tile aligning and leveling system comprising:
a base;
a top angled member;
a bottom angled member;
a strap comprising:
a top angled member mating protuberance;
said bottom angled member disposed adjacent said strap;
said bottom angled member having a top ramp side; and
said top angled member disposed on and configured to slide on said top ramp side.

2. The system of claim 1 further comprising a shell disposed over a portion of said top angled member and said bottom tile angled member.

3. The system of claim 2 wherein said shell has a of slot therein for receiving therethrough a first top shim post.

4. The system of claim 3 further comprising a second top shim post.

5. The system of claim 4 wherein said top angled member has a handle end which is configured to remain separated from said bottom angled member and allow use as a handle.

6. A lippage control system comprising:
a member for cooperating with a first side of a plurality of adjacent tiles;
an elongated interstitial member extending away from said first side and beyond an opposing second side of said plurality of tiles;
a first wedge for providing a variably positionable ramp;
a second wedge configured for sliding up said ramp;
said second wedge comprising a top second wedge first surface and a bottom second wedge second surface;
a post disposed centrally along an longitudinal axis of said elongated interstitial member; and
said post configured for coupling with said first surface.

7. The system of claim 6 further comprising a shell having opposing and separate sides each having a post receiving groove therein for guiding one of a pair of opposing posts as said second wedge is slid across said ramp.

8. The system of claim 7 wherein said shell has a floor which is configured to contact said second side of said plurality of tiles and further having a first central hole therein which is sized and configured to allow said shell to be place over a top end of said elongated interstitial member and further configured to allow said pair of opposing posts to be located within said shell.

9. The system of claim 8 wherein said shell having a top region between opposing and separate sides where said top region has a second central hole therein which is sized and configured to allow said shell to move further down said elongated interstitial member and further configured to allow said pair of opposing posts to be located at least partially above said top region of said shell.

10. The system of claim 9 wherein said first wedge has a longitudinal axis and a skew slot extending from a thin end of said first wedge toward a thick end of said first wedge, where a skewed slot is configured for allowing said elongated interstitial member to slide into said skewed slot.

11. The system of claim 10 wherein said first wedge has a wedge central hole therein which is sized and configured to allow said shell, with said first wedge fully inserted therein, to be placed over a top end of said elongated interstitial member and further configured to allow said pair of opposing posts to be located within said shell.

12. The system of claim 11 wherein said first central hole and said wedge central hole are in registration so as to facilitate vertically moving said shell along said elongated interstitial member.

13. A lippage reducing system comprising:
a member configured to be located between a plurality of adjacent tiles in a back plane;
a strap extending from said member between said plurality of adjacent tiles and away from said back plane;
a first shim configured to engage a first surface of said plurality of adjacent tiles and to receive said strap through a void in said first shim; and
a second shim disposed adjacent to said first shim and configured to slide on said first shim.

14. The system of claim 13 wherein said strap comprises a central protuberance for mating with an outer surface of said second shim.

15. The system of claim 14 further comprising a ridge disposed on said central protuberance for engaging with surface features on said outer surface of said second shim.

16. The system of claim 15 wherein said member is disposed beneath said plurality of adjacent tiles, said first shim is a bottom shim disposed on top of said plurality of adjacent tiles and said second shim is a top shim disposed above said bottom shim.

17. The system of claim 15 further comprising a plurality of ridges disposed on said central protuberance.

18. The system of claim 13 further comprising a shell disposed around a central portion of said first shim and a central portion of said second shim, where said shell has a first groove therein for receiving a first protuberance coupled to said second shim.

19. The system of claim 18 wherein said shell has a first open end for receiving therein said first shim and an opposing end second open end for receiving therein said second shim, where the direction of insertion of said first shim into said shell is substantially opposite to a direction of insertion of said second shim.

20. The system of claim 19 wherein said second shim has a handle end which is configured to remain separated from said first shim and allow use as a handle.

* * * * *